US010107251B2

(12) United States Patent
Marrs et al.

(10) Patent No.: US 10,107,251 B2
(45) Date of Patent: Oct. 23, 2018

(54) IGNITION COIL HAVING A WINDING FORM

(71) Applicant: MARSHALL ELECTRIC CORP., Rochester, IN (US)

(72) Inventors: Thomas C. Marrs, Rochester, IN (US); Donald Recupido, Argos, IN (US)

(73) Assignee: MARSHALL ELECTRIC CORP., Rochester, IN (US)

( * ) Notice: Subject to any disclaimer, the term of this patent is extended or adjusted under 35 U.S.C. 154(b) by 93 days.

(21) Appl. No.: 15/220,857

(22) Filed: Jul. 27, 2016

(65) Prior Publication Data

US 2018/0030946 A1 Feb. 1, 2018

(51) Int. Cl.

| | |
|---|---|
| ***H01F 27/32*** | (2006.01) |
| ***H01F 38/12*** | (2006.01) |
| ***F02P 7/067*** | (2006.01) |
| ***H01T 15/00*** | (2006.01) |
| *H01F 5/02* | (2006.01) |
| *F02P 3/04* | (2006.01) |
| *F02P 7/03* | (2006.01) |

(52) U.S. Cl.

CPC ..... *F02P 7/067* (2013.01); *H01F 27/325* (2013.01); *H01F 38/12* (2013.01); *H01T 15/00* (2013.01); *F02P 3/0442* (2013.01); *F02P 7/035* (2013.01); *H01F 2005/022* (2013.01)

(58) Field of Classification Search

CPC ..... H01F 38/12; H01F 27/022; H01F 27/02; H01F 27/306; H01F 27/325

USPC ..... 336/90, 92, 96, 98, 196, 198; 123/621, 123/622, 634, 635

See application file for complete search history.

(56) References Cited

U.S. PATENT DOCUMENTS

| | | | | |
|---|---|---|---|---|
| 4,388,568 | A * | 6/1983 | Goseberg | H01F 38/42 315/411 |
| 4,684,912 | A * | 8/1987 | Kiltie | H01F 27/325 336/185 |
| 4,945,332 | A * | 7/1990 | Sakamoto | H01F 17/041 333/176 |
| 5,938,143 | A | 8/1999 | Yukitakae | |
| 6,215,385 | B1 * | 4/2001 | Ogden | H01F 38/12 123/634 |
| 6,294,973 | B1 * | 9/2001 | Kimura | H01F 38/12 336/107 |
| 6,337,616 | B1 * | 1/2002 | Sato | H01F 38/12 336/234 |
| 6,417,752 | B1 | 7/2002 | Heritier-Best | |
| 6,950,005 | B2 * | 9/2005 | Christopherson | H01F 5/02 336/198 |

(Continued)

*Primary Examiner* — Tsz Chan

(74) *Attorney, Agent, or Firm* — Egbert Law Offices, PLLC

(57) ABSTRACT

An ignition coil has a ferromagnetic core, a primary coil surrounding a portion of the core and wrapped helically with a conductor, a winding form having partitions extending outwardly of a tubular surface of the winding form, and a secondary coil wrapped on the winding form. The partitions define a plurality of annular coil chambers including central chambers and end chambers. The end chambers have a spiral land. The secondary coil includes coil sections in each of the plurality of coil chambers. The secondary coil has coil turns in the end chambers in a spiral configuration on the spiral land and increasing progressively in diameter toward the central chambers.

14 Claims, 6 Drawing Sheets

(56) References Cited

U.S. PATENT DOCUMENTS

| | | | | |
|---|---|---|---|---|
| 7,595,714 | B2 * | 9/2009 | Wada | H01F 38/12 336/90 |
| 7,969,268 | B2 | 6/2011 | Dal Re et al. | |
| 8,319,591 | B2 * | 11/2012 | Fujiyama | H01F 38/12 123/634 |
| 2003/0106956 | A1 | 6/2003 | Moga et al. | |

* cited by examiner

IGNITION COIL HAVING A WINDING FORM

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to high-voltage transformers and especially to those used in ignition systems for internal combustion engines. More particularly, the present invention relates to tubular winding forms or bobbins for the secondary windings of an ignition transformer wherein the primary windings and the ferromagnetic core are located within the winding form.

2. Description of Related Art Including Information Disclosed Under 37 CFR 1.97 and 37 CFR 1.98

High-voltage transformers for ignition systems in modern internal combustion engines generally include a tubular winding form that receives a ferromagnetic core (generally of a laminated construction), primary winding surrounding the core and secondary windings wrapped around the winding form. The transformers generally capable of producing a secondary voltage of around 30 KV or more.

The winding form usually has a plurality of axially spaced annular partitions that define annular chambers therebetween. The turns of the secondary windings are wound in the first chamber at one end until the chambers build to a desired level. Then, the windings proceed to the next chamber such as by passing the wire through a helical transition slot formed in the respective partition and then filling the next adjacent chamber to the same level. This process is continued until all of the chambers are filled progressively from one end to the other. The actual winding of the secondary coil is usually accomplished with automatic coil winding equipment.

In modern ignition systems, higher energy coils and spark gaps are being used (e.g. such as in the range of 0.05 inches and higher) in order to achieve better ignition of the fuel. As a result, higher sparking voltages are necessary, such as voltage in excess of 30 KV. The ignition coils are the subject to much greater voltage stress than in the past.

In order to accommodate this, several coils are used in the system, such as one coil for every one or two spark plugs. In the two spark plug configuration, one end of the secondary coil is connected to one plug and the opposite end is connected to the other plug which is set to fire at an opposite portion of the engine cycle.

One problem that can occur during operation of modern automotive ignition systems is sparking across adjacent coil turns during collapse of the transformer field at the firing point. The firing or arcing across the spark gap of the plug generates an RF voltage that may be reflected back to the secondary coil. This high voltage transient or spike may have a frequency of around 10 MHz. The resulting RF energy is quickly dissipated in the first three or four turns of the secondary coil, however, the high RF voltage does present a danger of arcing in the first few turns of the closely coupled wire. In fact, arcing from one end turn to the next frequently does occur, resulting in deterioration of the insulation on the conductor and of the dielectric material in which the conductor is embedded. This can also occur on those coil-on/over plug-type coil assemblies.

Testing has been accomplished on these coil ignition systems in nitrogen atmosphere pressure vessels under conditions that simulate actual engine operation and with the voltage level adjusted to provide optimum sparking. The tests verify that the RF voltage spikes generated causes deterioration of the insulation of the first few turns of the coil and thus premature coil failure. The frequency and magnitude of the reflected RF signal is a function of the sparking voltage and the size of the spark gap.

It is been suggested that a solution to this problem is to enlarge the secondary coil form or bobbin to provide greater spacing between the end turns. The spacing should be sufficient to eliminate arcing. While this may be an effective solution, the enlargement of the coil form is often not possible because of the criticality of the various components of the engine compartment of the vehicle and, in particular, the ignition system components.

In the past, various patents have issued relating to such winding forms. For example, U.S. Pat. No. 4,580,122, issued on Apr. 1, 1986 to P. Worz, describes an ignition coil for ignition systems of internal combustion engines. In particular, the secondary winding and the coil body carrying the ignition coil are manufactured in a chambered realization. The radial extension (i.e. height) of each chamber winding decreases toward the higher chamber potential in accordance with the law of geometric progression so that the insulating distance between the secondary winding and the areas of the ignition coil that carry a lower potential increases with an increasingly higher chamber potential.

U.S. Pat. No. 4,684,912, issued on Aug. 4, 1987 to Kiltie et al., describes a winding form for a high-voltage transformer. This winding form includes a ferromagnetic core, a primary coil and a secondary coil. The secondary windings are wrapped on a tubular insulating winding form or bobbin with annular radial portions defining a plurality of annular coil chambers including a plurality of central chambers and at least one end chamber. The end chamber defines a spiral land that proceeds both axially toward the respective end and radially outwardly for three or more complete turns. The respective end turns of the coil wrap one turn of coil on each turn of the spiral land so that successive turns of the end portions of the secondary coil are both axially and radially spaced from one another sufficient to minimize arcing.

U.S. Pat. No. 5,938,143, issued on Aug. 17, 1999 to K. Yukitakae, shows an ignition coil winding method for spirally winding an element wire in conical banks of wire turns one by one around the coil bobbin. In particular, a nozzle is provided that can vertically move toward and away from the coil bobbin accordingly changing the winding radius and can swing in the direction normal to the longitudinal axis of the bobbin to maintain constant tension of the element wire.

U.S. Pat. No. 6,417,752, issued on Jul. 9, 2002 to Heritier-Best, shows an ignition coil of the type intended to be mounted on a spark plug for the individual electrical supply of the spark plug. This ignition coil includes an internal secondary winding, an external primary winding, a flux return shell, and a casing. The casing surrounds only the secondary winding. The primary winding is wound onto the casing on the outside of the casing. The flux return shell surrounds the casing.

U.S. Pat. No. 7,969,268, issued on Jun. 28, 2011 to Dal Re et al., provides an ignition coil configured for electrical communication with a spark plug of an internal combustion engine. The ignition coil has a primary spool and a secondary spool. The primary spool has a bore and an outer surface with a low-voltage winding supported thereon. The secondary spool has a cavity with a magnetic core received therein at a substantially cylindrical outer surface. The secondary spool is received at least partially in the bore of the primary spool. A high-voltage winding is supported on the outer surface of the secondary spool. The high-voltage winding has discrete winding sectors spaced from one another along the length of the secondary spool.

U.S. Patent Publication No. 2003/0106956, published on Jun. 12, 2003 to Moga et al., teaches a coil winding system for making a secondary winding of an automotive ignition coil. The system includes a roller configured to apply a folding force to the wire being dispensed from a wire nozzle onto a bobbin. The nozzle and the roller are removed by a drive mechanism under control of a controller from one axial end to the other axial end of the bobbin for winding the bobbin in a progressive winding fashion. The roller allows an increase in the winding angle of the layers so as to reduce the voltage difference between adjacent layers and thus reduce incidence of dielectric breakdown in that region.

It is an object of the present invention to reduce and/or eliminate arcing in the end turns of the secondary windings of a combustion engine ignition transformer.

It is another object of the present invention to minimize the possibility of such arcing without changing the dimensional parameters of the secondary windings of the transformer or of the coil form or winding form.

It is another object of the present invention to provide an ignition coil which avoids deterioration of the insulation on the conductor and the dielectric on which the conductor is embedded.

These and other objects and advantages of the present invention will become apparent from a reading of the attached specification and appended claims.

BRIEF SUMMARY OF THE INVENTION

The present invention is an ignition coil that comprises a ferromagnetic core, a primary coil surrounding a portion of the core in which the primary coil is wrapped helically with a conductor, a winding form having partitions extending outwardly of the tubular surface of the winding form so as to define a plurality of annular coil chambers including central chambers and end chambers, and a secondary coil wrapped on the winding form including coil sections in each of the plurality of coil chambers. The secondary coil has coil turns in the end chambers in a spiral configuration on the spiral land increasing progressively in diameter toward the central chambers.

Each of the end chambers as a depth less than a depth of the central chamber. The partitions of one of the end chambers have generally equal diameters. The partitions of this one of the end chambers being adjacent to the end of the winding form. The partitions of the end chamber progressively decrease in radius from the central chamber. One of the end chambers has a greater width than another end chamber.

In particular, the end chambers of the present invention include a first end chamber adjacent one of the central chambers, a second end chamber on a side of the first end chamber opposite the central chamber, a third end chamber on a side of the second end chamber opposite the first end chamber, and a fourth end chamber on a side of the third end chamber opposite the second end chamber. The first end chamber has a greater radius than the second end chamber. The second end chamber has a greater radius than the third end chamber. The fourth end chamber has a greater volume than each of the first, second and third end chambers. A bottom of the third end chamber is even with the bottom of the fourth end chamber. A bottom of the first end chamber has a greater radius than the bottom of the second end chamber. The bottom of the second end chamber has a greater radius than a bottom of the third end chamber.

The secondary coil has coil turns in which successive turns in the end chambers are axially and radially spaced from one another so as to prevent arcing.

The objects and advantages the present invention are achieved with the unique secondary coil winding form of the present invention which includes a tubular member of dielectric material having annular partitions defining a plurality of annular coil chambers including the central chambers and the end chambers. The end chambers include a spiral land that continues for several turns. The secondary coil that is wrapped on the form includes coil sections in each of the coil chambers. The coil turns of each of the end chambers are positioned of a spiral configuration in the spiral lands and have an inner end. The coil turns decrease progressively toward the outer end of the winding form. Accordingly, successive turns of the end portions of the secondary coil located in the end chambers are both axially and radially spaced from one another so as to reduce the end bay turn-to-turn coupled capacitance.

The present invention is also an ignition system that comprises a spark plug; a power supply; and an ignition coil connected to the spark plug and to the power supply. The ignition coil includes a ferromagnetic core, a primary coil surrounding a portion of the core with the primary coil being wrapped helically with a conductor, a winding form having partitions extending outwardly of the tubular surface of the winding form so as to define a plurality of annular coil chambers including central chambers and end chambers and in which the end chambers have a spiral land, and a secondary coil wrapped on the winding form including coil sections in each of the plurality of coil chambers. The secondary coil has coil turns in the end chambers in a spiral configuration on the spiral land that increase progressively in diameter toward the central chambers.

In the ignition system of the present invention, each of the end chambers as a depth less than a depth of the central chamber. The partitions of the end chamber progressively decrease in radius from the central chambers. One of the end chambers has a greater width than another of the end chambers. At least two partitions of the end chamber decrease in diameter from the central chambers toward an end of the winding form. The secondary coil has coil turns in which successive turns in the end chambers are axially and radially spaced from one another so as to prevent arcing. Each of the partitions has an annular shape. The winding form surrounds the primary coil and the core.

The present invention is also a winding form for use in an ignition coil. This winding form includes a tubular member having partitions extending outwardly of a tubular surface of the tubular member. The partitions include a plurality of annular coil chambers including central chambers and end chambers. The end chambers have a spiral land. The radius of the bottom of each of the end chambers progressively increases in a direction toward the central chambers.

This foregoing Section is intended to describe, with particularity, the preferred embodiments of the present invention. It is understood that modifications to these preferred embodiments can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
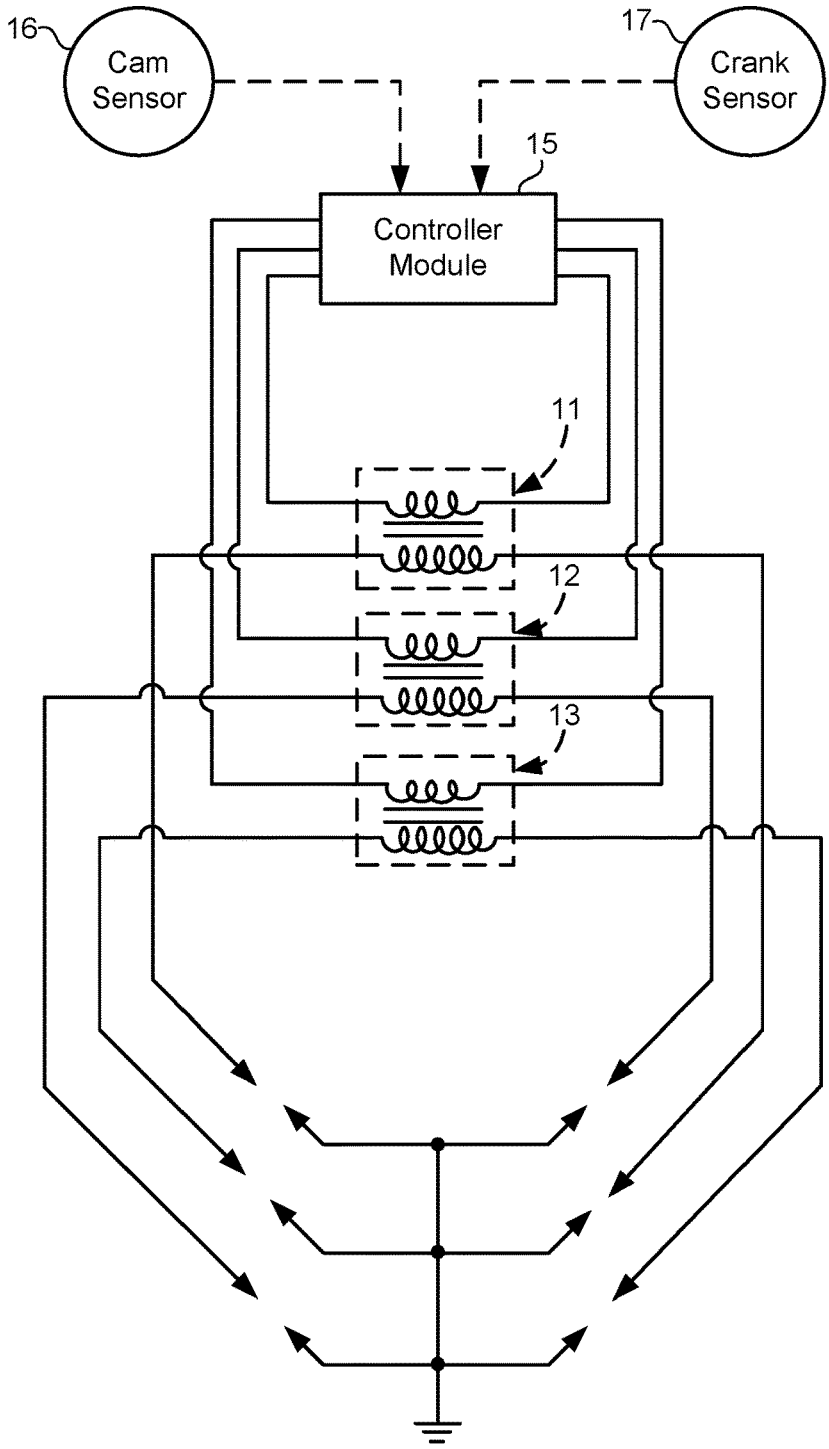
FIG. 1 is a schematic diagram illustrating a typical ignition system for modern internal combustion engine and including three ignition transformers, one for every two cylinders.

Referring more particularly to the drawings and initially to FIG. 1, there shown an electronic ignition system typical of those used in modern automotive vehicle engines. The system illustrated is designed for a typical six-cylinder engine where the crankshaft cranks lie in a planar configuration. The system utilizes three separate ignition transformers 11, 12 and 13, one for each of two cylinders that fire at opposite portions of the engine cycle.

The system includes a cam sensor 16 and a crank sensor 17 that input to a control module IS, which connects to the primary windings of the transformers 11, 12 and 13. The primary windings are energized to time the firing of the plugs that are fired by the respective secondary windings. The windings are energized in opposite modes depending upon the particular spark plug to be fired. The plugs for the cylinder pairs are fired sequentially by the secondary coil of the transformer 11.

Figure 2:
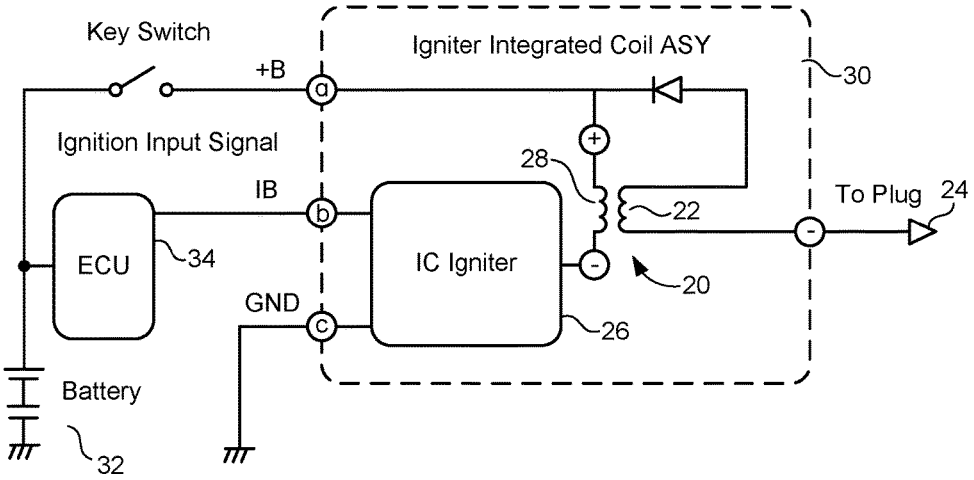
FIG. 2 is a schematic diagram illustrating the ignition system of the present invention as used in association with an electronic control unit and with a single plug in a coil on/over plug configuration.

FIG. 2 is a schematic illustration showing the coil-on/coil-over plug configuration. In particular, the transformer 20 has secondary 22 connected to the plug 24. The ignition coil igniter 26 is connected to the primary 28 of the transformer 20. The transformer 20 and the igniter 26 are contained within an igniter integrated coil assembly 30. The power supply 32 is a battery that can be connected to an electronic control unit 34. The electronic control unit causes the function of and the timing of the coil operation to be based upon information processed by the control unit.

Figure 3:
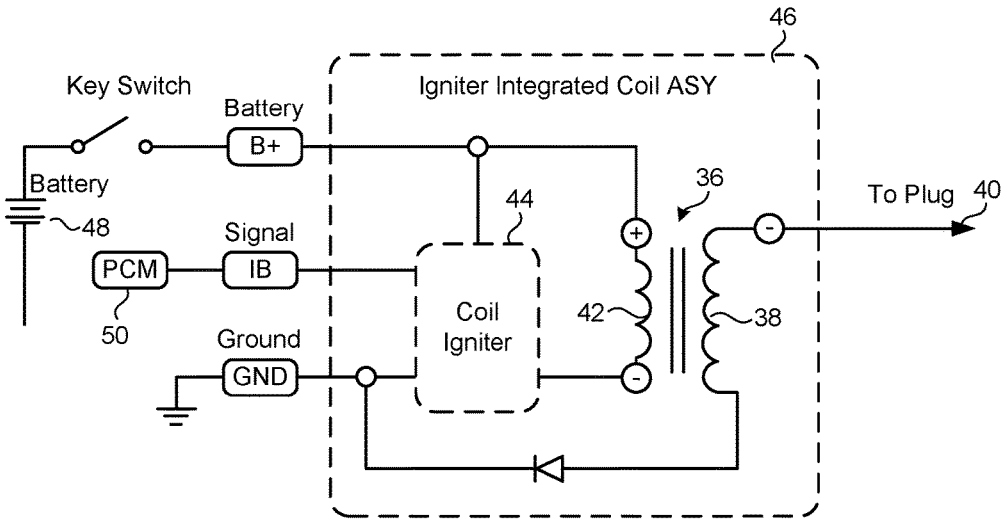
FIG. 3 is a schematic diagram illustrating the ignition system of the present invention as used in association with a programmable control module and a coil-on/over plug configuration.

FIG. 3 is a schematic illustrating the transformer 36 as used in association with a coil-on/coil-over plug configuration. In particular, the secondary 38 of the transformer 36 is connected to plug 40. The primary 42 of the transformer 36 can be connected to coil igniter 44. The transformer 36 and the coil igniter 44 are maintained within an igniter integrated coil assembly 46. The power supply is provided by battery 48. A programmable control module 50 provides a signal to the coil igniter 44 so as to control the function of and the timing of the coil operation based on information processed by the control unit.

Figure 4:
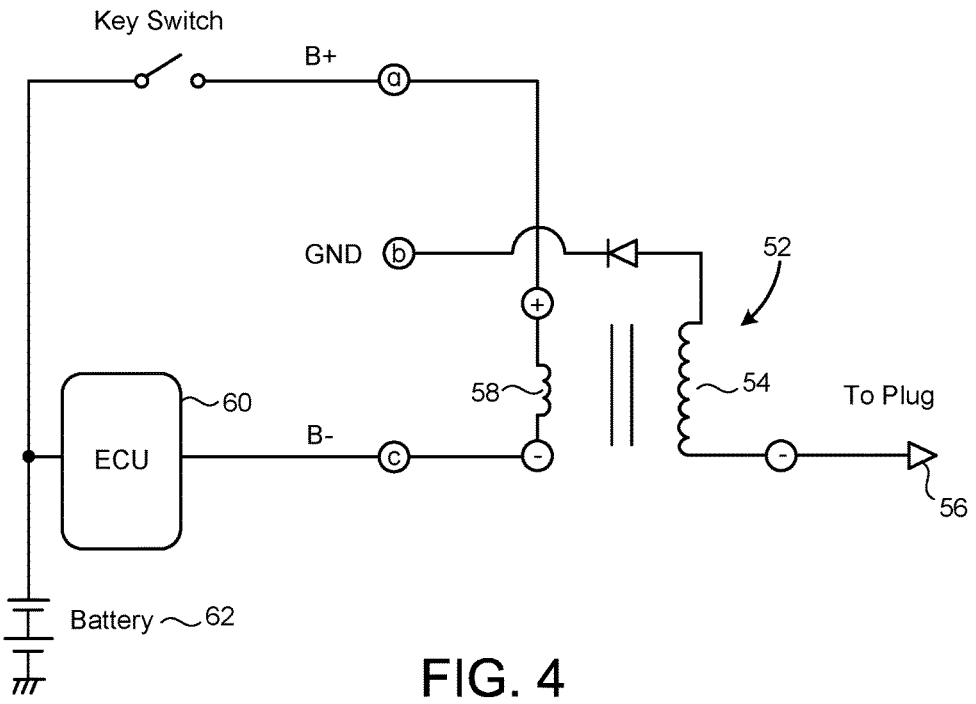
FIG. 4 is a schematic diagram illustrating the ignition system of the present invention for use as part of a passive coil in an coil on/over plug configuration.

FIG. 4 shows a passive coil assembly. In particular, the transformer 52 has secondary 54 connected to plug 56. The primary 58 is connected to the electronic control unit 60. A battery 62 provides power to the electronic control unit 60 and, as such, to the primary 54 of the transformer 52.

In the transformers described in FIGS. 1-4, the transformers will be of the type shown hereinafter. The transformer comprises a laminated, ferromagnetic core 70 of a standard construction, a primary coil 71 wrapped on a winding tube 72 that surrounds one portion of the core 70, a secondary coil 73 wrapped on a winding form for bobbin 74 that surrounds and is concentric with the primary coil 71 and the primary winding tube 72.

Figure 5:
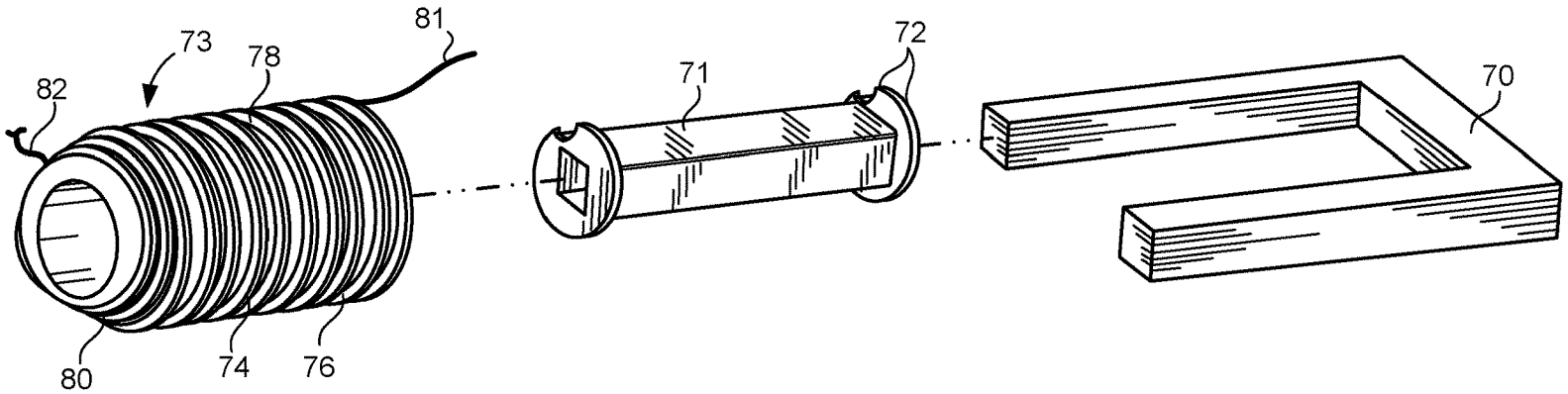
FIG. 5 is an exploded perspective view shown in the ignition transformer of the present invention.

In FIG. 5, it can be seen that the winding form 74 has a unique configuration. In particular, the winding form has partitions 76 extending outwardly of a tubular surface of the winding form 74. These partitions define a plurality of annular coil chambers including central chambers 78 and end chambers 80. The end chambers 80 have a spiral land. The secondary coil 73 is wrapped on the winding form 74 in each of the plurality of coil chambers 78. The secondary coil 43 has leads 81 and 82 extending therefrom at opposite ends of the winding form 74.

Figure 6:
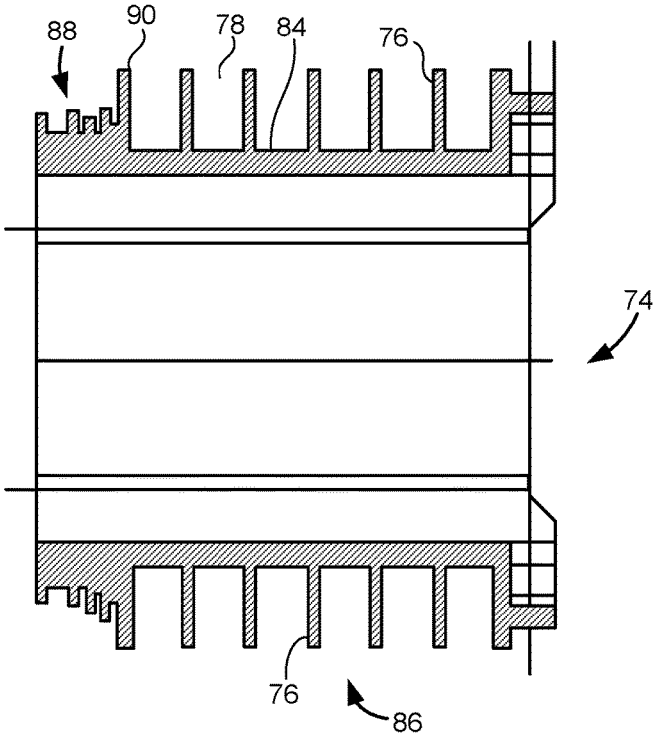
FIG. 6 is a cross-sectional side elevational view showing the winding form as used in the ignition coil of the present invention.

FIG. 6 particularly illustrates the winding form 74. In particular, it can be seen that the partitions 76 extend radially outwardly of a tubular surface 84 of the winding form 74. These partitions define a plurality of annular coil chambers 78 including central chambers 86 and end chambers 88.

In FIG. 6, it can be seen that each of the end chambers 88 has a depth less than a depth of each of the central chambers 86. Each of the partitions 76 of the central chambers 86 extend outwardly of the tubular surface 84 for an approximate equal distance. The end chambers 88 will be adjacent to an end partition 90 of the plurality of central chambers 86.

The winding form 74 of the present invention is of a generally tubular cylindrical form with the outer tubular surface 84. The partitions 76 extend radially in spaced relationship from each other so as to define the plurality of central chambers 86. Each of the plurality of central chambers 86 will receive a plurality of coil turns. The wire is wrapped from one end to the other using coil winding machines at a well known in the art. The coil is passed from one partition to the other through transitions slots (not shown) that extend in a somewhat diagonal direction through the respective partitions 76. The end chambers 88 are adapted to receive three or more turns of wire forming the secondary coil at the end of the winding form 74.

Figure 7:
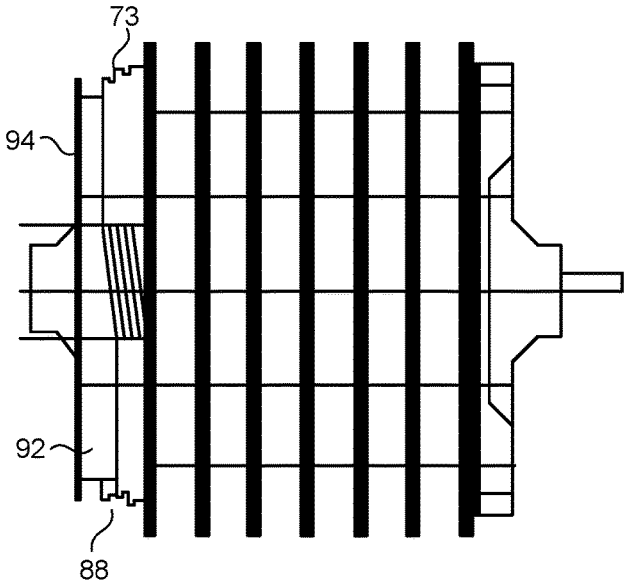
FIG. 7 is a side elevational view showing the winding form of the ignition coil of the present invention and having turns of coil on the spiral land of the end chambers.

FIG. 7 illustrates the secondary coil 73 as received within the end chambers 88. As can be seen, the partitions in the end chambers 88 form a spiral land for the secondary coil 73. Each of the end chambers 88 receive a single turn of the secondary coil 73. Importantly, it can be seen that there is an end chamber 92 that does not receive a turn of the secondary coil 73 therein. As such, this end chamber 92 will space the turns of the other end chamber from the end partition 94.

Figure 8:
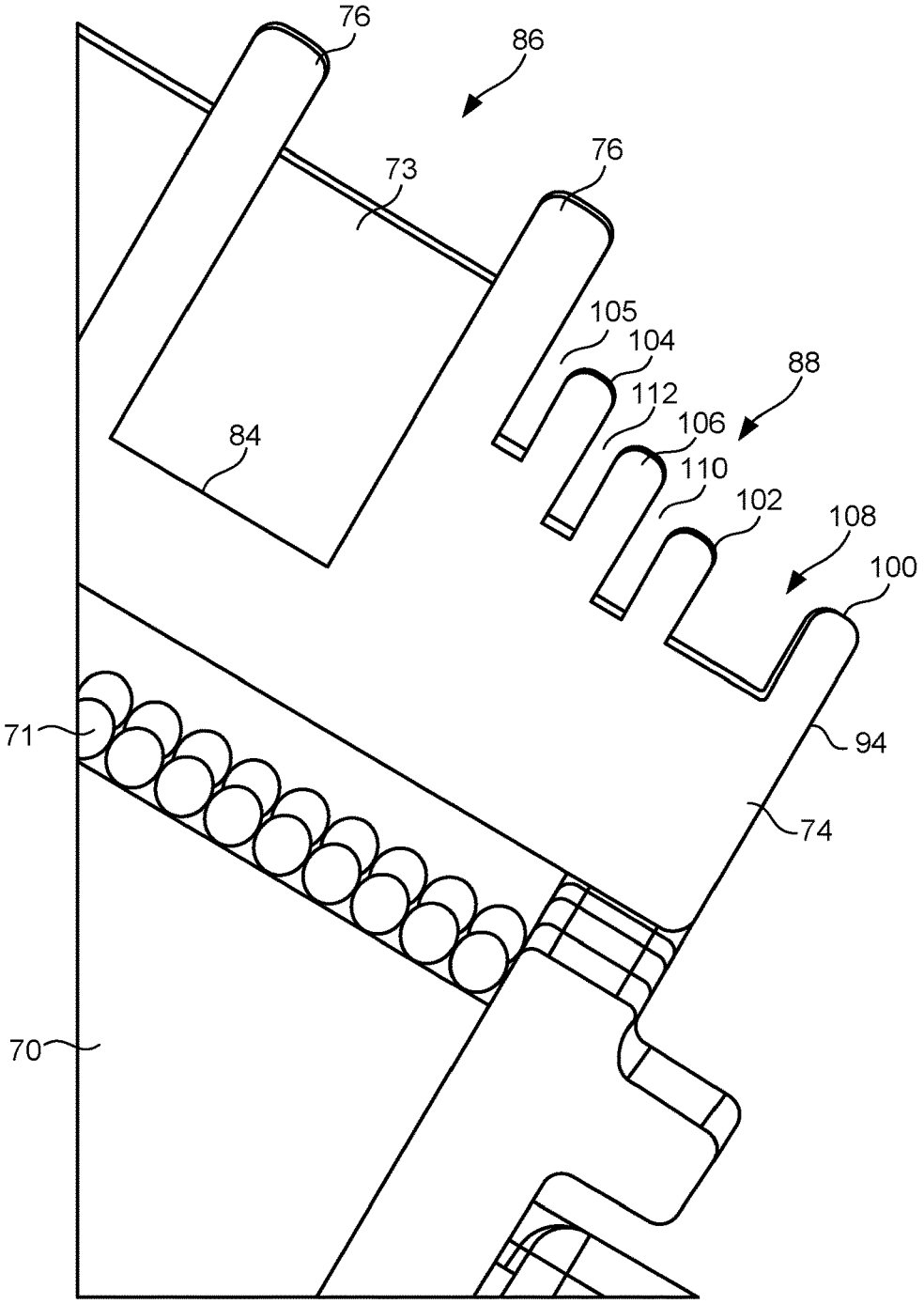
FIG. 8 is a detailed perspective view showing the particular configuration of the end chambers as used on the winding form of the ignition coil of the present invention.

FIG. 8 is a detailed view showing the end chambers 88 formed on the winding form 74. FIG. 8 further shows that the winding form 74 is placed over and around the ferromagnetic core 70 and over the primary coil 71. FIG. 8 further shows that the partitions 76 are arranged in spaced parallel relationship to each other and each has a generally equal radius extending outwardly from the tubular surface 84 of the winding form 74. FIG. 8 further shows that the secondary coil 73 generally fills each of the chambers of the central chambers 86 that are defined by the partitions 76.

The end chambers 88 which receive respective turns of the secondary coil 73 have a unique configuration. It can be seen that each of the end chambers 88 has a depth that is less than the depth of each of the central chambers 86. In particular, the respective bottoms of each of the end chambers 86 can be seen as extending radially outwardly for a greater distance than the tubular surface 84 associated with the central chambers 86. It can be seen that partitions 100 and 102 of the end chambers 88 have a generally equal diameter. The partition 100 is adjacent to the end 94 of the winding form 74. The partitions 104, 106 and 102 generally progressively decrease in radius from in a direction away from the central chambers 86. It can be seen that the chamber 108 that is defined by the partitions 100 and 102 has a greater width than the chambers 110, 112 and 114 of the remaining end chambers 88 and, as such, operates as to spacing area.

In particular, the end chambers 88 include a first end chamber 105 that is adjacent to one of the central chambers 86. The first end chamber 105 is defined between the partition 104 and the partition 76. The second end chamber 112 is on the side of the first end chamber 105 opposite to the central chambers 86. The second end chamber 112 is defined between the partitions 104 and 106. The third end chamber 110 is on a side of the second end chamber 112 opposite the first end chamber 105. The third end chamber is defined between the partitions 102 and 106. The fourth end chamber 108 is on a side of the third end chamber 110 opposite to the second end chamber 112. The fourth end chamber 108 is defined between the partitions 100 and 102. The first end chamber 105 has a greater radius than the second end chamber 112. The second end chamber 112 has a greater radius than the third end chamber 110. The fourth end chamber 108 has a greater volume than each of the first end chamber 105, the second end chamber 112 and the third end chamber 110. It can be seen that the bottom of the third end chamber 110 is even or level with the bottom of the fourth end chamber 108. The bottom of the first end chamber 105 has a greater radius than a bottom of the second end chamber 112. The bottom of the second end chamber 112 has a greater radius than the bottom of the third end chamber 110. The secondary coil 73 will have coil turns in the end chambers 88 in a spiral configuration on the spiral land so as to increase progressively in diameter toward the central chambers 86. The secondary coil 73 will have coil turns in which successive turns in each of the chambers 105, 112 and 110 are axially and radially spaced from one another so as to prevent arcing.

In order to achieve optimum advantage of the increased turns spacing provided by the spiral land configuration, the rate of increase in the radius of the progressive turns varies. For example, where the spiral land would have four turns, the space between the largest turn and the next largest turn is designed as to be twice as great as the space between the smallest turn and the next adjacent turn. This is because the voltage drop from one coil to the next (and thus the potential for arcing) is greatest in the first end turn of the coil and diminishes progressively for the first three or four turns. The desired relationship between the radii of adjacent turns of the spiral land will depend on many factors such as space availability, size of the winding form, design parameters of the particular ignition system, etc. In particular, the greater volume offered by the end chamber 88 further spaces the secondary coil 73 so as to further reduce the potential for arcing.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

We claim:

1. An ignition system comprising:

a ferromagnetic core;

a primary coil surrounding a portion of said ferromagnetic core, said primary coil being wrapped helically with a conductor;

a winding form having partitions extending outwardly of a tubular surface of said winding form, said partitions defining a plurality of annular coil chambers including central chambers and end chambers, said end chambers having a spiral land; and a secondary coil wrapped on said winding form including coil sections in each of said plurality of coil chambers, said second coil having coil turns in said end chambers in a spiral configuration on said spiral land and increasing progressively in diameter toward said central chamber, said end chambers comprising:

a first end chamber formed adjacent to one of said central chambers;

a second end chamber formed on a side of said first end chamber opposite to said one of said central chambers;

a third end chamber formed on a side of said second end chamber opposite said first end chamber; and a fourth end chamber formed on a side of said third end chamber opposite said second end chamber, said fourth end chamber located adjacent an end of said winding form, said fourth end chamber having a greater volume and width than a volume and width of said third end chamber, a bottom of said third end chamber having a radius equal to a radius of a bottom of said fourth end chamber, a bottom of said first end chamber having a radius greater than a radius of a bottom of said second end chamber, a bottom of said second end chamber having a radius greater than a radius of a bottom of said third end chamber.

2. The ignition coil of claim 1, each of said end chambers has a depth less than a depth of said central chambers.

3. The ignition coil of claim 1, the partitions of one of said end chambers having a generally equal diameter.

4. The ignition coil claim 3, the partition of one of said end chambers being adjacent the end of said winding form.

5. The ignition coil of claim 1, the partitions of said end chambers progressively decreasing in radius from said central chambers.

6. The ignition coil claim 1, one of said end chambers having a greater width than another of said end chambers.

7. The ignition coil claim 1, at least two partitions of said end chambers decreasing in diameter from said central chamber toward an end of said winding form.

8. The ignition coil claim 1, said secondary coil having coil turns in which successive turns in said end chambers are axially and radially spaced from one another so as to prevent arcing.

9. An ignition system comprising:

a spark plug;

a power supply; and an ignition coil connected to said spark plug and to said power supply, said ignition coil comprising:

a ferromagnetic core;

a primary coil surrounding a portion of the core, said primary coil being wrapped helically with a conductor;

a winding form having partitions extending outwardly of a tubular surface of said winding form, said partitions defining a plurality of annular coil chambers including central chambers and end chambers, said end chambers having a spiral land; and a secondary coil wrapped on said winding form and including coil sections in each of said plurality of coil chambers, said secondary coil having coil turns in said end chambers in a spiral configuration on said spiral land and increasing progressively in diameter toward said central chamber, said end chambers comprising:

a first end chamber formed adjacent to one of said central chambers;

a second end chamber formed on a side of said first end chamber opposite to said one of said central chambers;

a third end chamber formed on a side of said second end chamber opposite said first end chamber; and a fourth end chamber formed on a side of said third end chamber opposite said second end chamber, said fourth end chamber located adjacent an end of said winding form, said fourth end chamber having a greater volume and width than a volume and width of said third end chamber, a bottom of said third end chamber having a radius equal to a radius of a bottom of said fourth end chamber, a bottom of said first end chamber having a radius greater than a radius of a bottom of said second end chamber, a bottom of said second end chamber having a radius greater than a radius of a bottom of said third end chamber.

10. The ignition system of claim 9, wherein each of said end chambers have a depth less than a depth of said central chambers.

11. The ignition system of claim 9, the partitions of said end chambers progressively decreasing in radius from said central chamber.

12. The ignition system of claim 9, one of said end chambers having a greater width than another of said end chambers.

13. The ignition system of claim 9, said secondary coil having coil turns in which successive turns in said end chambers are axially and radially spaced from one another so as to prevent arcing.

14. The ignition system of claim 9, each of said partitions having an annular shape, said winding form surrounding said primary coil and said core.

* * * * *